US006619523B1

(12) United States Patent
Duckworth

(10) Patent No.: US 6,619,523 B1
(45) Date of Patent: Sep. 16, 2003

(54) BACKPACK INCLUDING INTEGRAL VIBRATION DAMPER

(76) Inventor: David G. Duckworth, 1081 Katella, Laguna Beach, CA (US) 92651

( * ) Notice: Subject to any disclaimer, the term of this patent is extended or adjusted under 35 U.S.C. 154(b) by 0 days.

(21) Appl. No.: 10/104,809

(22) Filed: Mar. 20, 2002

Related U.S. Application Data

(63) Continuation of application No. 09/481,617, filed on Jan. 12, 2000, now abandoned.

(51) Int. Cl.[7] ..... A45F 3/00
(52) U.S. Cl. ..... 224/634; 224/635; 224/641
(58) Field of Search ..... 224/634, 633, 224/635, 641

(56) References Cited

U.S. PATENT DOCUMENTS 1,275,514 A * 8/1918 Wolak ..... 224/158
5,503,314 A * 4/1996 Fiscus ..... 224/262
5,762,251 A * 6/1998 Gleason ..... 224/635

* cited by examiner

*Primary Examiner*—Stephen K. Cronin
*Assistant Examiner*—Maerena W. Brevard
(74) *Attorney, Agent, or Firm*—Drummond & Duckworth

(57) ABSTRACT

An improved backpack is provided including a frame, pack shell, shoulder straps and waist strap. Connecting the pack shell to the frame of the backpack are one or more vibration dampers. Preferably, the vibration damper includes a cylindrical housing formed with a vertically extending bore aligned with the housing's central axis. A bore is configured for telescopic receipt of the siderails of the backpack frame. Located within the bore of the vibration damper is a spring which attenuates movement between the vibration damper's housing and a collar which radially projects from a portion of the frame's siderails. Preferably, the vibration damper includes an adjustable air valve for selectively controlling air to enter into and out of the chamber formed within the center of the vibration damper.

13 Claims, 2 Drawing Sheets

BACKPACK INCLUDING INTEGRAL VIBRATION DAMPER

This application is a continuation application of U.S. application Ser. No. 09/481,617, filed Jan. 12, 2000 now abandoned.

BACKGROUND OF THE INVENTION

The present invention relates to backpacks. More particularly, the present invention relates to an improved structure for a backpack which is more comfortable to the wearer and alleviates stress and strain to the wearer's back, legs and shoulders.

In recent years, backpacking has become a very popular activity for serious hikers and for those simply interested in leisurely walks through the environment. Depending on a person's physical condition and determination, the activity can be carried over gently rolling terrain, along wooded trails and even in mountainous areas. Many long hikes require large capacity pack shells that are capable of carrying food and supplies. Depending on the strength and size of the hiker, these pack shells can weigh in excess of 70 pounds. Backpacks including large capacity pack shells are in common use and are generally very tall and bulky. These backpacks typically include a waist band and a pair of shoulder straps for attaching the backpack to a person. When adjusted properly to a person, it is intended that the waistband carry 70% or more of the weight in the pack shell upon the wearer's hips, with the remaining weight being distributed on the wearer's shoulders.

It is important that the backpack be as comfortable as possible for the hiker to carry. Otherwise, hiking can become a miserable and exhausting experience. Unfortunately, not only does a hiker support the weight of the backpack, but when walking, the hiker receives substantial additional impact forces as the pack shell moves upwardly and downwardly with the wearer's stride. As the hiker walks, the backpack undergoes a substantially sinusoidal motion as the pack shell rises upwardly and downwardly. Each time the hiker places weight upon one of his feet, the pack shell reaches it lowest point in the cycle at which time the pack shell imparts substantial impact forces, caused by the weight in the pack shell reversing its downward direction, to be transferred to the shoulder straps and weight belt of the backpack, and thereafter to the muscles and bones of the hiker. This is a particular problem when the hiker is walking downhill as the pack shell's vertical movement, and downward velocity, is greater prior to being temporarily halted by a hiker's foot striking the ground.

The physical shock upon the body of a hiker can be expressed by the mathematics and physics principals of force, impulse, momentum and kinetic energy. In accordance with Isaac Newton's second law, the force upon the body of a hiker caused by the downward deceleration of the backpack is equal to:

$$\text{force}=(\text{mass of backpack})\times(\text{change in velocity})$$

In other words, the downward deceleration and subsequent upward acceleration of the backpack exert a force on the hiker's body with each step he takes. This force is in addition the downward force which is exerted substantially continuously on the hiker's body by the weight of the backpack itself.

Meanwhile, the sum of forces over a very short time period is called an impulse force. For example, when a baseball is struck, the contact between bat and ball is called an impulse force. Similarly, when a backpack "bounces" on a hiker's back, equal and opposite impulse forces are exerted on the backpack and hiker's body with each step that a hiker takes. Over time, the sum of these forces can cause substantial fatigue, tight muscles and possible damage to a hiker's body after a considerable amount of time is spent hiking.

Furthermore, the mass and downward velocity of the backpack while hiking can also be expressed as kinetic energy by the equation:

$$\text{kinetic energy}=\tfrac{1}{2}\times(\text{mass of backpack})\times(\text{downward velocity of backpack})^2$$

In order to stop the downward movement of the backpack while walking, this kinetic energy must be absorbed through the body of the hiker.

In addition to the above described forces and "shock" imparted upon a hiker's body, the upward and downward movement of the backpack imparts corresponding jarring of the pack shell and the contents within the pack shell. This substantial jarring can cause objects within the pack shell to move around and become unwantedly disturbed. This unwanted jarring can also damage fragile goods within the pack shell which is particularly troublesome where the objects carried within the pack shell are valuable or even invaluable, such as where the pack shell is constructed to carry a child.

There is thus a substantial need for an improved backpack which is light weight and comfortable to wear.

There is also a need for a backpack which reduces the amount of impulse forces which are imparted to the bones and muscles of a hiker when hiking.

Moreover, there is a need for a backpack which reduces the amount of jarring undergone by pack shell and the contents within the pack shell.

SUMMARY OF THE INVENTION

The present invention addresses the aforementioned problems by providing an improved backpack which incorporates an integral vibration damper.

The present invention provides for an improved backpack which is more comfortable for a hiker to wear by damping the downward velocity of the pack shell while walking. More particularly, the present invention is directed to a backpack which includes a vibration damper which connects the pack shell to the frame of a backpack. With each step, the downward movement of the pack shell is damped prior to the impact forces being transmitted to the wearer through the waist strap and shoulder straps of the backpack.

The present invention provides for a backpack including a frame, pack shell, shoulder straps and waist strap. The shoulder straps and waist strap attach the backpack to a person in typical fashion. The frame includes two or more vertical siderails and two or more horizontal rails. A backpack of the present invention further includes a vibration damper. The vibration damper connects the pack shell to the vertical siderails of the frame.

In a preferred embodiment, the vibration damper includes a cylindrical housing having a central chamber. Extending vertically through the vertical axis of the cylindrical housing is a central bore. The bore is configured for telescopic receipt of the siderail of the backpack frame. The vibration damper further includes a spring disposed vertically within the chamber of the vibration damper being annularly aligned with the bore and sidewalls of the housing. In a preferred embodiment, the chamber of the vibration damper is substantially air tight except for an air release valve which is located on either the housing's sidewall or upper planar surface. Finally, the vibration damper is further constructed to connect to the pack shell of a backpack. To this end, the vibration damper includes a clip, loop, tab or strap for attaching to a pack shell to the backpack frame.

The backpack of the present invention preferably includes two or more vibration dampers which are attached to the backpack frame. When assembled, the vibration dampers are attached to the outermost siderails of the backpack frame by telescopically receiving the siderails through the vibration damper's central bore. Formed annularly around the exterior of each siderail is a collar. Each siderail projects through the bores of a vibration damper so that the frame collars are disposed within the chamber of the vibration damper with the spring being placed in compression between the housing's upper surface and the frame's collar.

In a preferred embodiment, the vibration dampers are positioned toward the bottom of the frame sidewalls. This construction has the advantage of permitting most of the weight of the back pack and its contents to be carried by the lower portion of the backpack frame. In operation, the vibration dampers move vertically with the vibration dampers' springs compressing as the dampers slide downwardly upon collars formed on the frame siderails. The pack shell is attached to the vibration dampers by a clip or strap or similar means such that the weight in the pack shell places a downward force on the vibration dampers and place the springs in compression. By placing the vibration dampers at the lower extremities of the frame, the weight of the pack shell is carried substantially at the lower portion of the frame.

In an additional embodiment, the vibration dampers are positioned upon the uppermost extremities of the frame's outer siderails. The upper extremities of the siderails project through the bores constructed in the vibration damper's lower surfaces to engage the vibration dampers' springs. Again, a pack shell is attached to the vibration dampers so that the weight of the pack shell and any supplies or materials therein cause a downward force upon the vibration damper and the vibration damper's central spring is placed in compression.

When a hiker wears the backpack of the present invention, the weight of the pack shell is transmitted to the frame of the backpack through the vibration damper. The upward or downward movement of the pack shell is transmitted through the spring thus damping the vertical movement of the pack shell relative to the frame and thus limiting the impulse forces transmitted by the pack shell upon the frame and one wearing the backpack.

In a preferred embodiment, the vibration dampers are substantially air tight except for an air release valve which projects through the housing sidewall or upper surface. As would be understood by those skilled in the art, the collar extends radially to engage the inner surface of the housing sidewall, inhibiting the ability of the vibration damper to move vertically upon the vertical siderails of the frame as any relative movement between the siderails and the vibration damper would change the internal pressure within the chamber. The air release valve provides the ability to adjustably allow air into and out of the chamber. This air release valve functions as an additional pneumatic damper similar to the pneumatic shocks on an automobile. Adjusting the ability of air to flow in and out of the chamber, allows one to adjustably control the damping of the vibration damper.

It is thus an object of the present invention to provide an improved backpack which is more comfortable to the backpack wearer.

It is an additional object of the present invention to provide a damper for damping the relative movement between the pack shell and the frame of a backpack while hiking.

It is still an additional object of the present invention to reduce the jarring which takes place within a backpack when hiking which would thus reduce the amount of movement or damage to objects within a pack shell when hiking.

These and other and more specific objects and advantages of the invention will be apparent to those skilled in the art from the following detailed description taken in conjunction with the following drawings.

BRIEF DESCRIPTION OF THE DRAWINGS

FIG.. 1A is a front view of the backpack of the present invention including vibration dampers located on the lower extremities of the backpack's frame.

DETAILED DESCRIPTION OF THE INVENTION

Figure 1A:
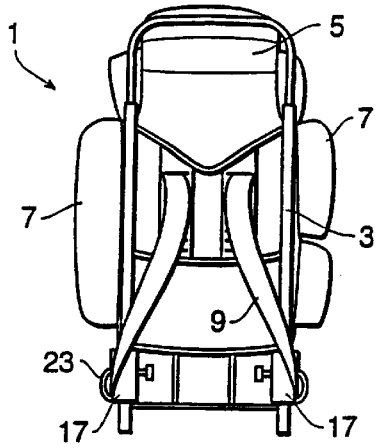
FIG. 1B is a front view of the backpack of the present invention including vibration dampers located on the upper extremities of the backpack's frame.

While the present invention is susceptible of embodiment in various forms, there is shown in the drawings and will hereinafter be described the presently preferred embodiments of the invention, with the understanding that the present disclosure is to be considered as an exemplification of the invention and is not intended to limit the invention to the specific embodiments illustrated.

As shown in FIGS. 1A, 1B, 6 and 7, the improved backpack 1 of the present invention includes a frame 3, shoulder straps 9 and a waist strap 11. The frame includes two or more vertical siderails 13 and two or more horizontal rails 15. Attached to the back of the backpack 1 is a main pack shell 5, and preferably one or more side pack shells 7.

The backpack 1 of the present invention also includes a vibration damper 17 which connects the main pack shell 5 and side packs 7 to the backpack frame 3. As shown in FIGS. 2–5, the vibration damper 17 includes a housing 19 which is formed with a vertically extending bore 20 which forms a central chamber 25. Preferably, the housing 19 is cylindrically shaped, having a sidewall 22 and an upper surface 24 and lower surface 26. The vibration damper 17 also includes a spring 21 which is vertically aligned within the chamber 25 so as to be positioned annularly with respect to the vibration damper's 17 central bore 20. In an additional preferred embodiment, the vibration damper 17 also includes an air release valve 27 for providing additional pneumatic damping of movement of the pack shell 5 relative to the backpack frame 3. The air release valve 27 is adjustable to permit a wearer of the backpack 1 to adjust the rate of air entering and exiting the central chamber 25 of the vibration damper 17. By adjusting the rate of air entering and exiting the central chamber 25 of the vibration damper 17, a hiker can adjust the pneumatic damping properties of the air release valve which may vary depending of the preferences of the individual hiker, his walking pace, his stride and the type of terrain in which one is hiking. Suitable air valves can be constructed without undue experimentation by those skilled in the art.

Figure 1B:
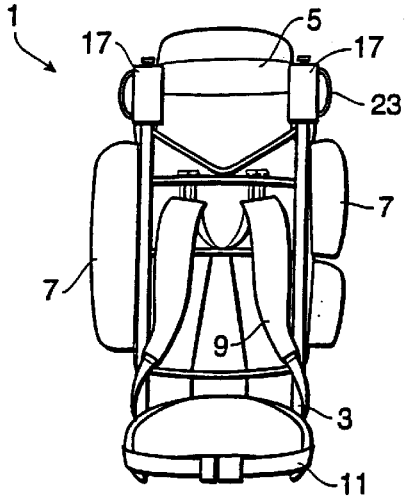
Figure 2:
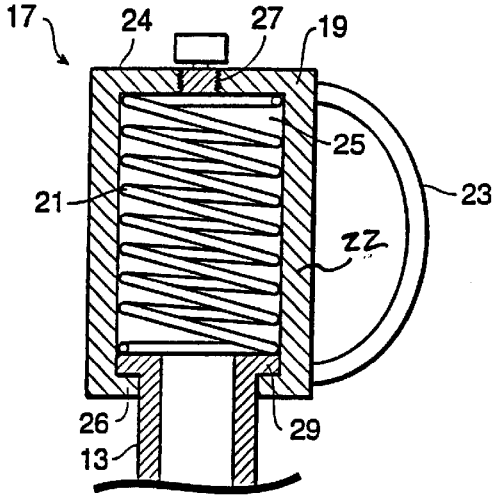
FIG. 2 is a first embodiment of the vibration damper for use with the backpack of the present invention.
Figure 3:
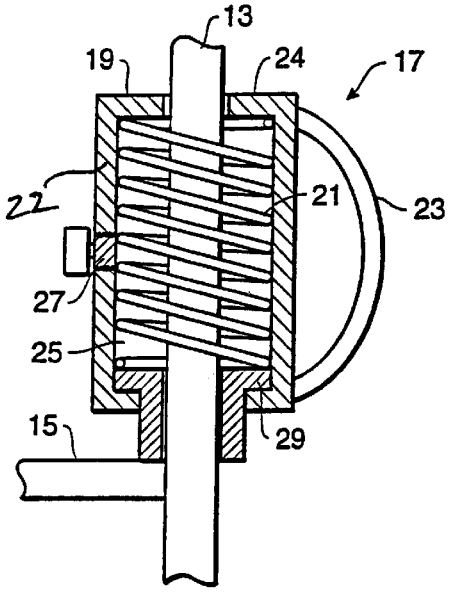
FIG. 3 is a second embodiment of the vibration damper for use with the backpack of the present invention.
Figure 4:
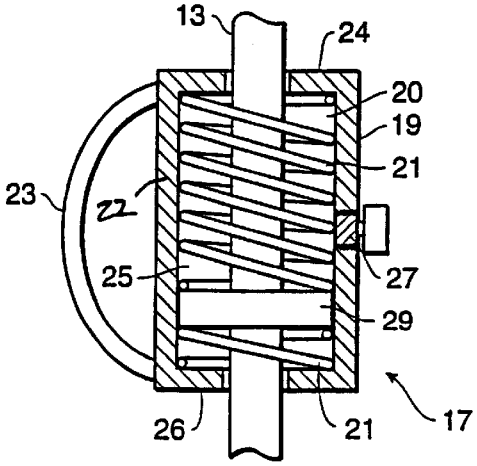
FIG. 4 is a third embodiment of the vibration damper for use of the backpack of the present invention.
Figure 5:
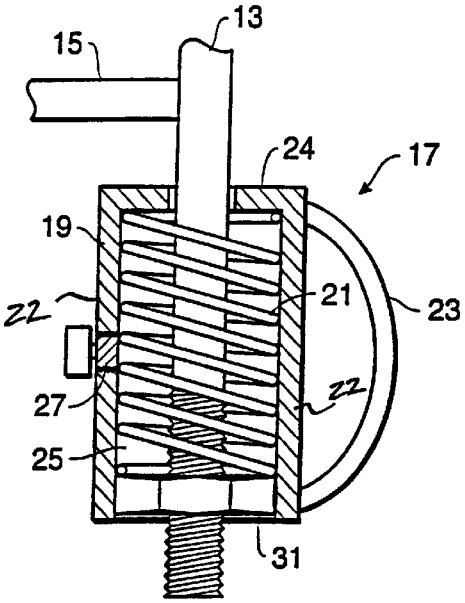
FIG. 5 is a fourth embodiment of the vibration damper for use of the backpack of the present invention.

Preferred embodiments of the present invention permit the vibration damper 17 to be positioned upon the upper most extremities of the backpack siderails 13, as shown in FIGS. 1B and 2, or the vibration damper 17 may be constructed to affix toward the lower extremity of the frame siderails 13, as shown in FIGS. 1A, 3, 4 and 5. Where the vibration damper 17 is mounted to the uppermost extremity of the frame siderails 13, the frame 3 is constructed with an annular collar 29 which is positioned within the chamber 25 of the vibration damper 17 below the spring 21. The frame 3 projects telescopically through the vibration damper's bore 20 so that the collar 29 is compressed between the spring 21 and the housing's lower surface 26. With reference to FIGS. 1A, 3 and 4, where the vibration damper 17 is constructed to engage the frame siderails 13 toward their lower extremities, the frame siderails 13 project telescopically through the entire vibration damper 17. Toward the lower extremities of the siderails 13, the siderails 13 include a radially projecting collar 29, again positioned between the spring 21 and the housing's lower surface 26.

As shown in FIGS. 1A, 1B, 6 and 7, the pack shells 5 and 7 are connected to the frame 3 by attaching to the vibration damper's clip 23 or strap 33 or similar means such that the weight in the pack shell places a downward force on the vibration dampers and place the internal springs 21 in compression. The weight of the pack shells 5 and 7, and the weight of any objects within the pack shells 5 and 7, cause a downward force upon the vibration damper's housing 19 which is counteracted by the upward force of the frame collar 29. Between these forces is the spring 21 which expands and contracts as the pack shell 5 and frame 3 move vertically relative to one another.

The characteristics of the springs 21 would vary depending on what is most comfortable to the backpack wearer, the weight of the pack and the type of hiking, whether cross country or mountainous. These characteristics are easily determinable by those skilled in the art. For example, where little weight is intended to be carried in the pack shell 5, or where the pack shell 5 is constructed to carry an infant of less than 20 pounds, the spring constant of the spring 21 would preferably be quite low, such as between 2½–20 pounds/inch with the spring 21 having a free range of movement between one inch and three inches. However, where the backpack 1 is constructed to carry 70 pounds or more over mountainous hiking, it is believed that the spring constant for each spring would be between 25 and 75 pounds/inch.

Figure 6:
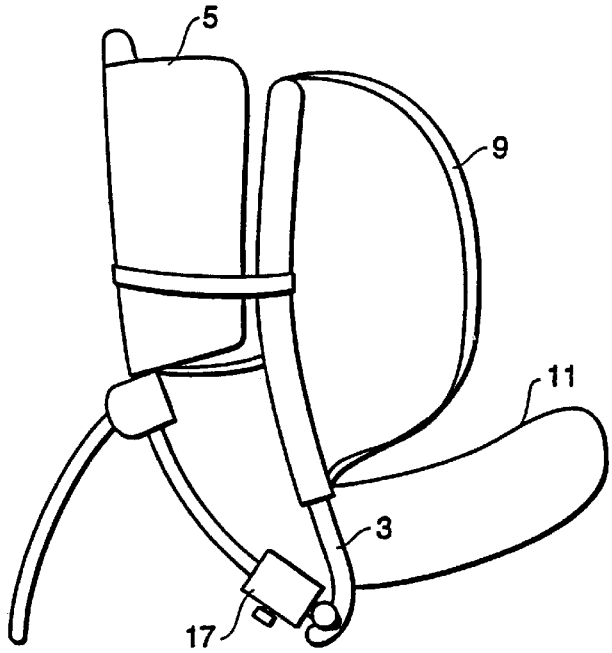
FIG. 6 is a side view illustrating the backpack including an integral vibration damper of the present invention with the pack shell constructed to carry a child, such as an infant.
Figure 7:
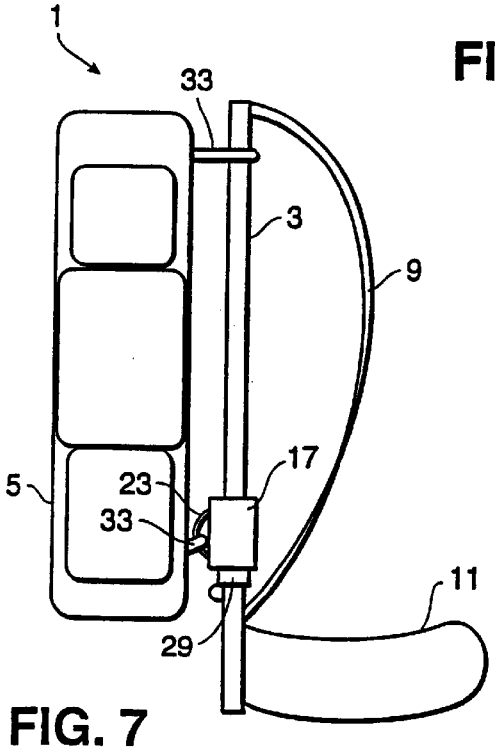
FIG. 7 is a side view illustrating the backpack including an integral vibration damper of the present invention.

Instead of substantial impact forces being imparted upon the frame 3, which are thereafter transmitted directly to the backpack wearer's body, the downward velocity of the pack is attenuated, the vibration of the backpack 1 is damped and the impulse forces of the backpack upon the hips and shoulders of the backpack are lessened prior to being borne upon by the backpack wearer by the damping effect of the spring and pneumatic damping action of the air release valve. Moreover, as would be understood by those skilled in the art, the vibration and impulse forces which are normally exerted upon the backpack wearer is also imparted on the pack shell 5 and the contents within the pack shell 5. Therefore, the backpack 1 of the present invention provides for reduced vibration and impact forces being imparted on the contents of the pack shell 5. With reference to FIG. 6, where the pack shell 5 is constructed to act as a "baby carrier", the backpack 1 of the present invention provides for a much more comfortable, and safer ride for a child residing within the pack shell 5. For this embodiment, vertical stays extending down from the back of the pack shell 5 projected telescopically into the vibration damper 17. The weight of a child within the pack shell places springs within the vibration dampers into compression, and any relative movement of a child within pack shell is attenuated with respect to the backpack frame 3. In essence, the vibration dampers 17 of back pack provide independent shock absorption for a child residing within the pack shell.

Although the present invention has been described with reference to the preferred embodiments, workers skilled in the art will recognize that changes may be made in form and detail without departing from the spirit and scope of the invention.

I claim:

1. A backpack incorporating an integral vibration damper, said backpack comprising:

a pack shell;

a frame having a pair of substantially vertical siderails;

an attachment means for attaching said frame to a person's back; and a pair of vibration dampers for connecting said frame to said pack shell, each of said vibration dampers including a housing having at least one opening and a central bore constructed for allowing one of said vertical siderails to telescopically slide within said opening and bore, each of said vibration dampers further including a spring positioned to engage said vertical siderail and said housing for damping the relative movement between said frame and said pack shell, each of said vibration dampers including a clip on said housing for attachment of said pack shell to said vibration dampers;

the backpack including said pack shell, frame, and vibration dampers all sized and assembled so as to position said pack shell adjacent to a person's back substantially above the waist of a person wearing said backpack.

2. The backpack incorporating an integral vibration damper of claim 1 wherein said attachment means includes a pair of shoulder straps connected to said frame.

3. The backpack incorporating an integral vibration damper of claim 1 wherein said spring attenuates the relative movement between said frame and said pack shell.

4. The backpack incorporating an integral vibration damper of claim 1 wherein said vibration dampers provide pneumatic damping for attenuating the relative vertical movement between said frame and said pack shell.

5. The backpack incorporating an integral vibration damper of claim 3 wherein said vibration dampers provide pneumatic damping for attenuating the relative vertical movement between said frame and said pack shell.

6. The backpack incorporating an integral vibration damper of claim 1 wherein said pack shell is constructed to hold a child.

7. The backpack incorporating an integral vibration damper of claim 6 wherein said spring attenuates the relative vertical movement between said frame and said pack shell.

8. The backpack incorporating an integral vibration damper of claim 6 wherein said vibration dampers provide pneumatic damping for attenuating the relative vertical movement between said frame and said pack shell.

9. A backpack frame incorporating an integral vibration damper, said backpack frame comprising:

a frame having a pair of substantially vertical siderails;

an attachment means for attaching said frame to a person's back;

a pair of vibration dampers for connecting said frame to a pack shell, each of said vibration dampers including a housing having at least one opening and a central bore constructed for allowing one of said vertical siderails to telescopically slide within said opening and bore, each of said vibration dampers further including a spring positioned to engage said vertical siderail and said housing for damping the relative movement between said frame and a pack;

each of said vibration dampers including a clip means on said housing for fastening said pack shell to said vibration dampers;

the backpack frame including frame, vibration dampers and clip all sized and assembled so as to position a pack adjacent to a person's back substantially above the waist of a person wearing said backpack.

10. The backpack frame incorporating an integral vibration damper of claim 10 wherein said attachment means includes a pair of shoulder straps connected to said frame.

11. The backpack frame incorporating an integral vibration damper of claim 10 wherein said vibration dampers include a spring for attenuating the relative vertical movement between said frame and said pack shell means.

12. The backpack frame incorporating an integral vibration damper of claim 10 wherein said vibration dampers provide pneumatic damping for attenuating the relative vertical movement between said frame and said pack shell means.

13. The backpack frame incorporating an integral vibration damper of claim 12 wherein said vibration dampers provide pneumatic damping for attenuating the relative vertical movement between said frame and said pack shell means.

* * * * *